US008430333B2

(12) United States Patent
Andre et al.

(10) Patent No.: US 8,430,333 B2
(45) Date of Patent: Apr. 30, 2013

(54) PREFABRICATED MODULE FOR THE TRACK OF A SELF-GUIDED URBAN TRANSPORT VEHICLE ON TYRES

(75) Inventors: Jean-Luc Andre, Molsheim (FR); Martin Klotz, Gresswiller (FR)

(73) Assignee: Lohr Industrie, Hangenbieten (FR)

( * ) Notice: Subject to any disclaimer, the term of this patent is extended or adjusted under 35 U.S.C. 154(b) by 379 days.

(21) Appl. No.: 12/674,011

(22) PCT Filed: Aug. 22, 2008

(86) PCT No.: PCT/FR2008/001205

§ 371 (c)(1),
(2), (4) Date: Mar. 16, 2010

(87) PCT Pub. No.: WO2009/060134

PCT Pub. Date: May 14, 2009

(65) Prior Publication Data

US 2011/0278366 A1 Nov. 17, 2011

(30) Foreign Application Priority Data

Aug. 29, 2007 (FR) ..... 07 06047

(51) Int. Cl.
*E01B 1/00* (2006.01)

(52) U.S. Cl.
USPC ..... 238/5; 238/7; 105/72.2

(58) Field of Classification Search ..... 238/5, 6, 238/7, 8, 9, 125, 122; 105/72.2, 215.1, 215.2
See application file for complete search history.

(56) References Cited

U.S. PATENT DOCUMENTS

| | | | | |
|---|---|---|---|---|
| 3,077,165 | A * | 2/1963 | Vittorelli | 104/247 |
| 4,968,178 | A * | 11/1990 | Koster et al. | 404/49 |
| 5,704,295 | A * | 1/1998 | Lohr | 105/72.2 |
| 5,758,583 | A * | 6/1998 | Lohr | 105/72.2 |
| 5,960,717 | A * | 10/1999 | Andre | 104/139 |
| 6,253,685 | B1 * | 7/2001 | Lohr | 104/244 |
| 6,752,322 | B2 * | 6/2004 | Ehrsam et al. | 238/283 |
| 7,484,669 | B2 * | 2/2009 | Gray, Jr. | 238/3 |
| 7,562,629 | B2 * | 7/2009 | Lohr et al. | 105/72 |
| 7,600,621 | B2 * | 10/2009 | Lohr et al. | 191/23 R |
| 8,052,067 | B2 * | 11/2011 | Andre | 238/129 |
| 8,091,797 | B2 * | 1/2012 | Reichel et al. | 238/8 |
| 2004/0182946 | A1 * | 9/2004 | Reichel et al. | 238/5 |

(Continued)

FOREIGN PATENT DOCUMENTS

| | | |
|---|---|---|
| FR | 2720083 A1 | 11/1995 |
| FR | 2862072 | 5/2005 |

(Continued)

*Primary Examiner* — Jason C Smith
(74) *Attorney, Agent, or Firm* — Davis & Bujold, PLLC

(57) ABSTRACT

A prefabricated module (1) to be used in constructing a track for an urban transport vehicle. The module comprises an integral carrier structure (2) made of concrete and comprising two side sills (4) having an upper surface (5), used as a driving pathway for the vehicle wheels, and connecting crossbars (8) which connect and retain the sills substantially parallel to each other. The lower surfaces (6, 39) of the sills and cross-bars are ground-bearing surfaces. A guiding rail section (3), mounted on the carrier structure, is preferably symmetrical, has an I section and a lower portion coated with a liner material (13). The modules, whether rectilinear or curved, are to be placed on an existing road layout or in a trench with a compacted bottom, and are connected one after the other to form the driving track.

18 Claims, 7 Drawing Sheets

U.S. PATENT DOCUMENTS

| | | | | |
|---|---|---|---|---|
| 2006/0017325 | A1* | 1/2006 | Lohr | 307/10.1 |
| 2006/0286830 | A1* | 12/2006 | Lohr et al. | 439/108 |
| 2007/0079724 | A1* | 4/2007 | Lohr et al. | 105/72.2 |
| 2007/0164125 | A1* | 7/2007 | Freudenstein et al. | 238/6 |
| 2010/0001088 | A1* | 1/2010 | Reichel et al. | 238/7 |
| 2010/0213268 | A1* | 8/2010 | Andre | 238/122 |
| 2010/0276503 | A1* | 11/2010 | Kowalski et al. | 238/7 |
| 2011/0036917 | A1* | 2/2011 | Bogl et al. | 238/7 |
| 2011/0278366 | A1* | 11/2011 | Andre et al. | 238/5 |

FOREIGN PATENT DOCUMENTS

| | | | |
|---|---|---|---|
| JP | 2006089968 | A | 4/2006 |
| WO | 2005/042844 | A2 | 5/2005 |
| WO | WO 2005042844 | A2 * | 5/2005 |

* cited by examiner

PREFABRICATED MODULE FOR THE TRACK OF A SELF-GUIDED URBAN TRANSPORT VEHICLE ON TYRES

This application is a National Stage completion of PCT/FR2008/001205 filed Aug. 22, 2008, which claims priority from French patent application serial no. 0706047 filed Aug. 29, 2007.

FIELD OF INVENTION

The present invention concerns a prefabricated track module for a self-guided urban transport vehicle traveling on tires and a track formed of a plurality of such prefabricated modules in succession.

BACKGROUND OF THE INVENTION

In order to eliminate congestion in the center of cities suffering from excessive automobile traffic, current urban policies tend towards the development of public transportation. As a result, large municipalities are using more and more trams, trolley-buses, and metropolitan type vehicles.

Of these vehicles, self-guided tramways on tires are especially advantageous for small or medium size cities. They are capable at least locally of sharing the road with conventional vehicles. They require little infrastructure preparation and can travel on relatively narrow streets. Additionally, they have a much larger capacity than buses, they are fast, and they are not exposed to the problems of city traffic when traveling on their own tracks.

However, they must operate on specially prepared tracks comprising travel surfaces and a guide rail, for example, a central rail. Installing them in an urban center requires a certain amount of work.

To construct them it is generally necessary to close one or more streets for an extended time, as long as it takes to dig a large enough ditch, reroute existing channels, prepare the terrain, pour foundations, build up areas for each element constituting the track, install and connect the various elements, construct the electrical network necessary for supplying current and signals, fill in and grade the areas adjacent to the track, repair the street damaged by the work, manage crossings and signals, etc.

Obviously all this work generates problems with traffic, parking, deliveries, access to businesses, noise, dirt, causing considerable long-term disturbance to residents, trades people, and anyone wishing to use the streets closed due to construction.

Thus, it is in everyone's best interests for the track construction work to be completed in the shortest possible time in order to minimize the difficulties it causes.

SUMMARY OF THE INVENTION

The object of the invention is therefore to provide a track with a simplified installation and thus requires much quicker construction time.

To resolve this technical problem, the track according to the invention is formed of prefabricated modules each consisting of a complete track section manufactured and assembled at the factory to be placed on prepared terrain, juxtaposed one after the other, and assembled in place with adjacent modules.

Because of this, the only tasks remaining after preparation of the terrain are to connect the modules to one another and perform the work of filling, finishing, and arranging. Numerous steps, especially those entailing down time such as waiting for concrete to set, take place in the factory and no longer in the urban environment, considerably reducing construction time and the inconvenience it causes.

The track modules according to the invention can be laid directly over an existing street or, for a track that is level with the street, on a simply prepared compacted terrain without requiring any foundation, a further considerable reduction in construction time.

Furthermore, because the prefabricated track modules are made in a factory, this ensures they are of high quality that can replicated; they are not subjected to variations in climate or to technical difficulties related to terrain as with conventional tracks built on location.

Additionally, subsequent maintenance of the track is also greatly simplified. If necessary, a defective module can be simply removed and replaced by another module without encountering problems relative to track integrity as with continuous tracks of the prior art.

In order to achieve these objectives, the invention provides track modules to be juxtaposed one after the other in order to form a track for a self-guided urban transport vehicle on tires.

According to the invention, these modules are prefabricated in a factory and each comprises:

- an integral monobloc supporting structure made of concrete comprising two lateral sills, the upper surface of which is generally flat and serves as a travel surface for the tires of the urban transport vehicle, and connecting crossbars joining the lateral sills and maintaining them generally parallel, with the lower surface of the lateral sills and of the connecting crossbars being ground-bearing surfaces; and
- a guide rail section mounted on the supporting structure preferentially at the substantially central position for guiding the urban transport vehicle.

The supporting structure advantageously is either entirely or partially made of reinforced concrete for increased solidity.

The prefabricated modules according to the invention are either rectilinear elements or they may be curved elements in order to form any desired track shape when placed in linear juxtaposition.

The curved track portions may also be made of smaller size elements, generally trapezoid in shape, which, when juxtaposed successively, form a segmented bend called "faceted" to accommodate the requirements of rear wheel deviation.

According to a first embodiment of the invention, the guide rail section may be fixed to the supporting structure at each of the crossbars using immobilizing pieces adapted for this purpose. This fixation is preferably achieved by wedging the rail section between two of these immobilizing elements bolted to the corresponding crossbar.

According to a second embodiment of the invention, the integral concrete supporting structure may comprise a supplementary intermediate sill located between the two lateral sills, preferably in the middle of them, to which the guide rail section is attached.

In this case the guide rail section may be affixed to the intermediate sill using appropriate immobilizing elements.

Alternatively, it may also be embedded in a complementary shaped channel formed in the intermediate sill.

According to a preferred embodiment of the invention, the guide rail is generally shaped like a bone or an "I." Its two extremities, e.g., a head serving as a contact surface for the vehicle guide roller or rollers and a foot, are preferably symmetrical and joined by a narrow elongated web forming the axis of the I.

This rail preferably does not have a large contact base at the lower portion and it has no significant lateral inertia. Therefore it is relatively flexible and can be made in a straight piece, then easily curved during positioning without any independent supplementary curving process occurring when manufacturing curved modules.

The lower portion of the guide rail section is preferably coated with a lining material forming a partial or complete covering that extends through at least one lateral extension defining a lateral guide groove between the extension and the head of the rail.

The lining material used is compressible, advantageously allowing any objects that might be found in the lateral guide channel to be evacuated, buried, or embedded inside when the guide roller passes.

The connection between these modules can be extremely limited and consists only of an assembly of successive guide rail portions joined with bolts or welded, with the sills simply positioned one against the other.

The guide rail can also be positioned after the supporting structure, allowing perfect curves to be formed in the guide rail and approximate curves to be formed at the level of the sills serving as travel supporting surfaces that are more tolerant.

According to an interesting embodiment, the extremities of the guide rail section and those of the lateral sills may be longitudinally offset. Then the connection between two successive sections of guide rail would not be at the end, but in the center of the sills, for example, with the guide rail then advantageously serving as the connection between modules.

The guide rail section may also be made longer than the sills on the supporting structure, especially on curves, which also allows it to serve as a connection between the sills.

BRIEF DESCRIPTION OF THE DRAWINGS

Other characteristics and features of the invention will become apparent when reading the following detailed description, taken with reference to the attached drawings, in which.

DETAILED DESCRIPTION OF THE PREFERRED EMBODIMENTS

Figure 1:
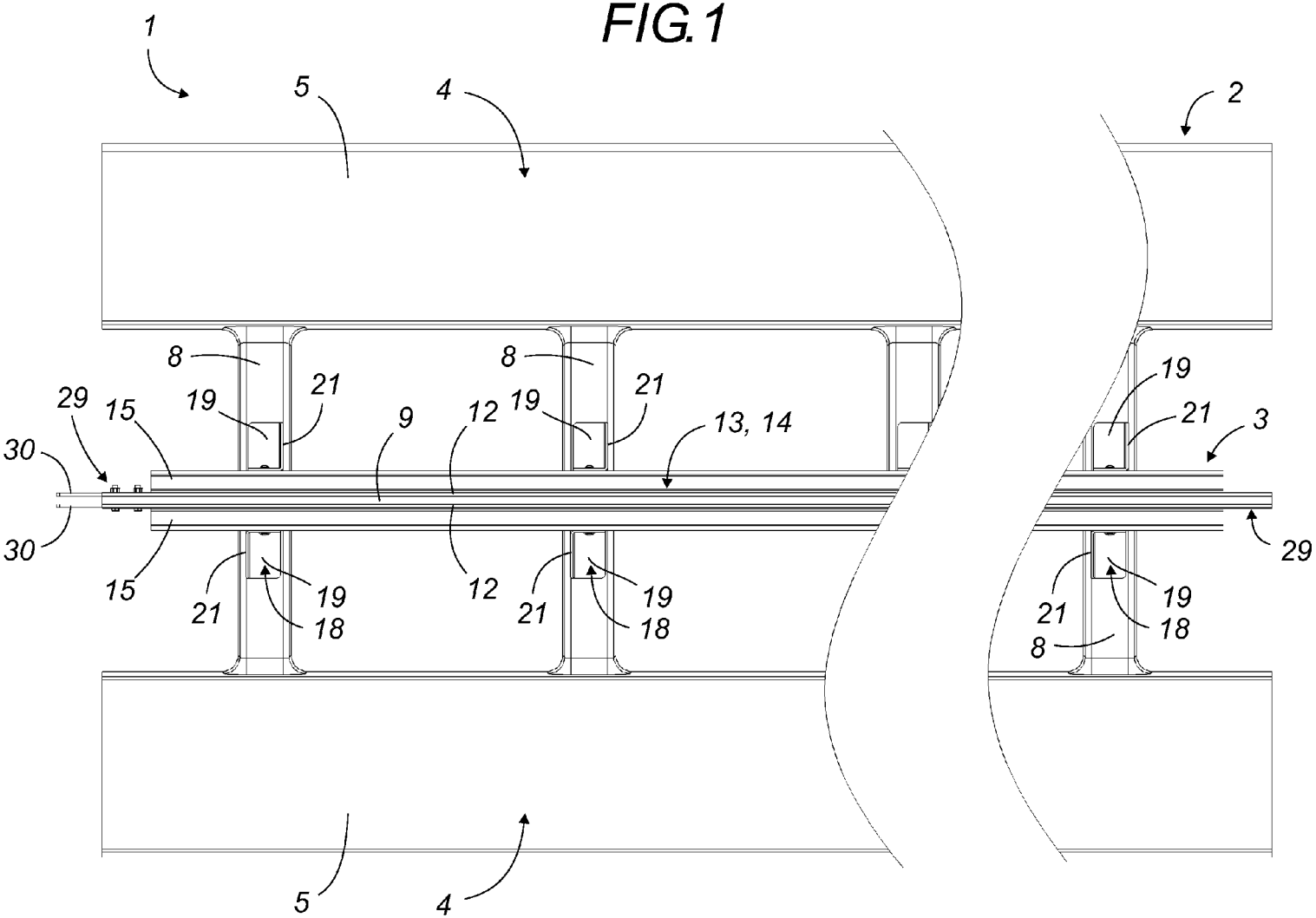
FIG. 1 is a plane overhead view of a prefabricated track module according to a first embodiment of the invention.
Figure 2:
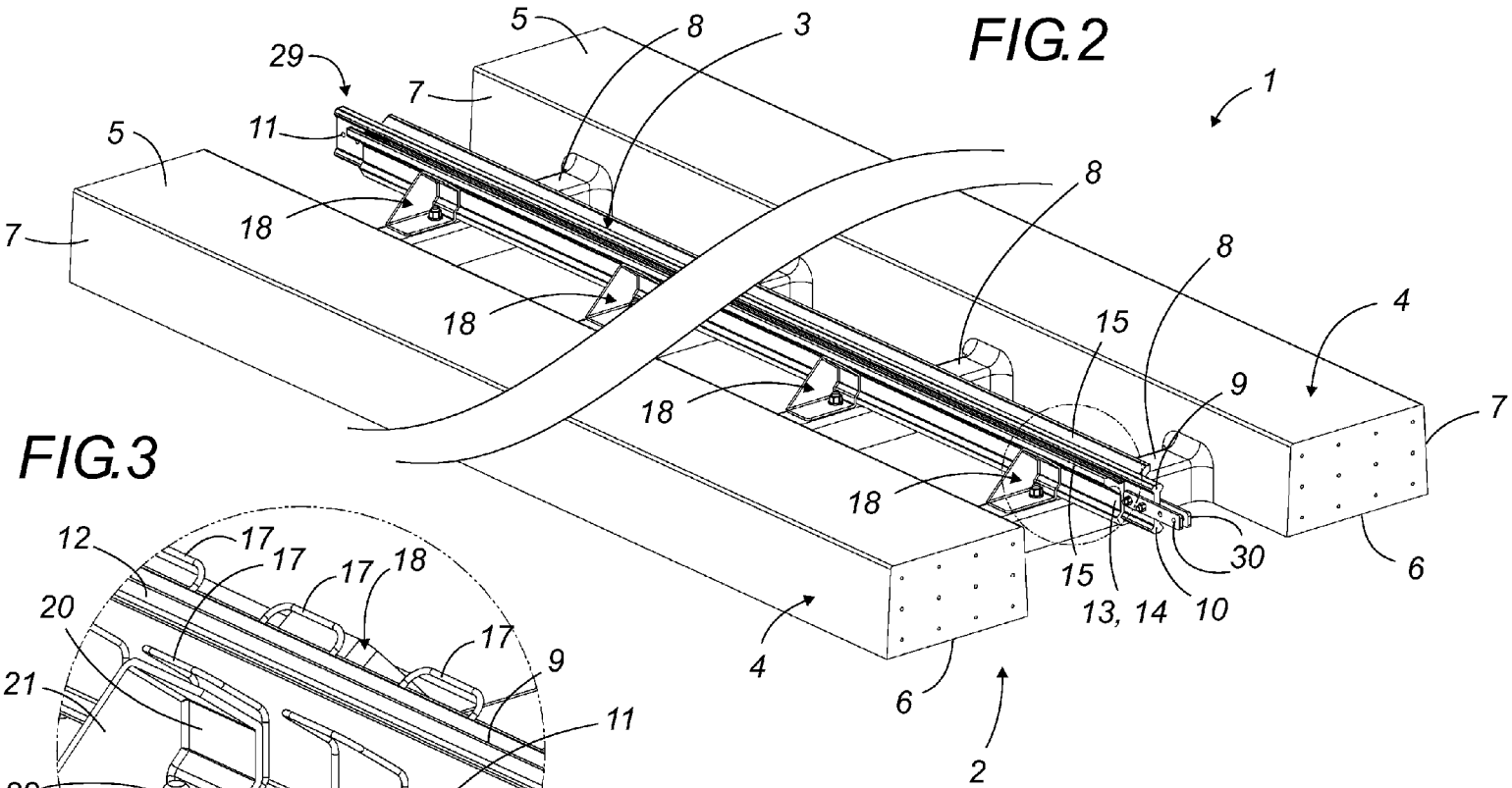
FIG. 2 is a perspective of the front of the prefabricated track module according to the first embodiment of the invention.

Two principal embodiments of a prefabricated track module according to the invention will now be described in detailed fashion with reference to FIGS. 1 through 12. It should be clearly understood, however, that these are only preferred embodiments of the invention, provided as examples, and not intended to limit the scope, which is defined in the attached claims. Equivalent elements shown in different drawings will bear the same reference numerals.

The various attached drawings show a prefabricated track module 1 according to the invention which when assembled in succession with several of these modules 1 forms a track for a self-guided urban transport vehicle equipped with tires.

This track module 1 comprises an integral supporting structure 2 to which a guide rail section 3 is attached for guiding an urban transport vehicle.

Supporting structure 2 is a unit that is factory made in one piece. It is made of concrete, preferably reinforced, that is, reinforced with a number of metal elements or with any type of appropriate framework made of metal or other material. Supporting structure 2 may be reinforced throughout or only in certain highly stressed areas that need to be more resistant.

Supporting structure 2 comprises two lateral sills 4 that extend on either side of the structure and are generally parallel. They consist of two concrete profile elements with a generally planar upper surface 5 serving as the travel surface for the wheels of the urban transport vehicle and a lower contact surface 6 which is preferably also planar.

Lateral sills 4 are designed to provide a resistant supporting surface adapted for urban transport vehicle traffic. The upper surface 5 of lateral sills 4 is therefore structured for improved adherence of the vehicle tires to the travel surface if there are difficult climatic conditions and may have adhering ribs that are not shown.

Upper surface 5 of lateral sills 4 may also be slightly convex in order to facilitate rainwater runoff.

Lower surface 6 of the lateral sills is a ground-bearing surface for supporting structure 2. Attaching structures may even be formed on the lower surface 6 of the sills for improved anchoring of supporting structure 2 on the ground.

Lateral sills 4 are preferably substantially rectangular in shape. They may also be trapezoidal to improve seating of supporting structure 2 or to form progressively inclined slopes for lateral surfaces 7 when the module is designed for placement above ground level.

Supporting structure 2 also comprises a group of connecting crossbars 8 which join lateral sills 4 and keep them generally parallel.

Figure 4:
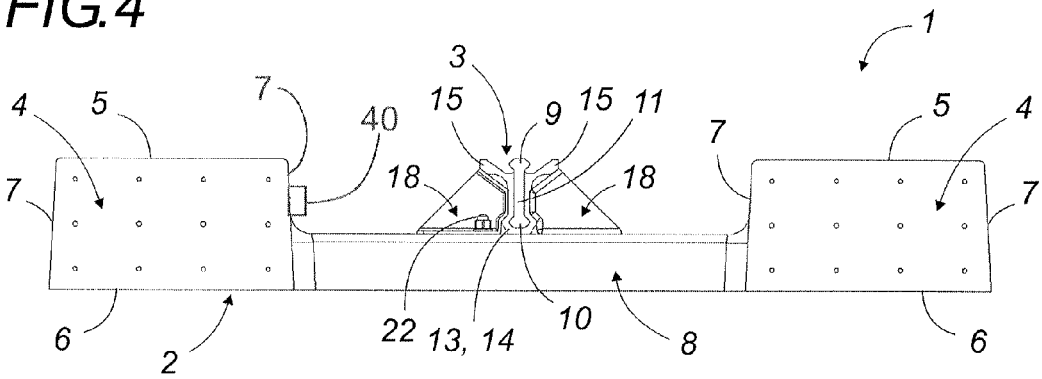
FIG. 4 is a plane rear view of the prefabricated track module according to the first embodiment of the invention.
Figure 5:
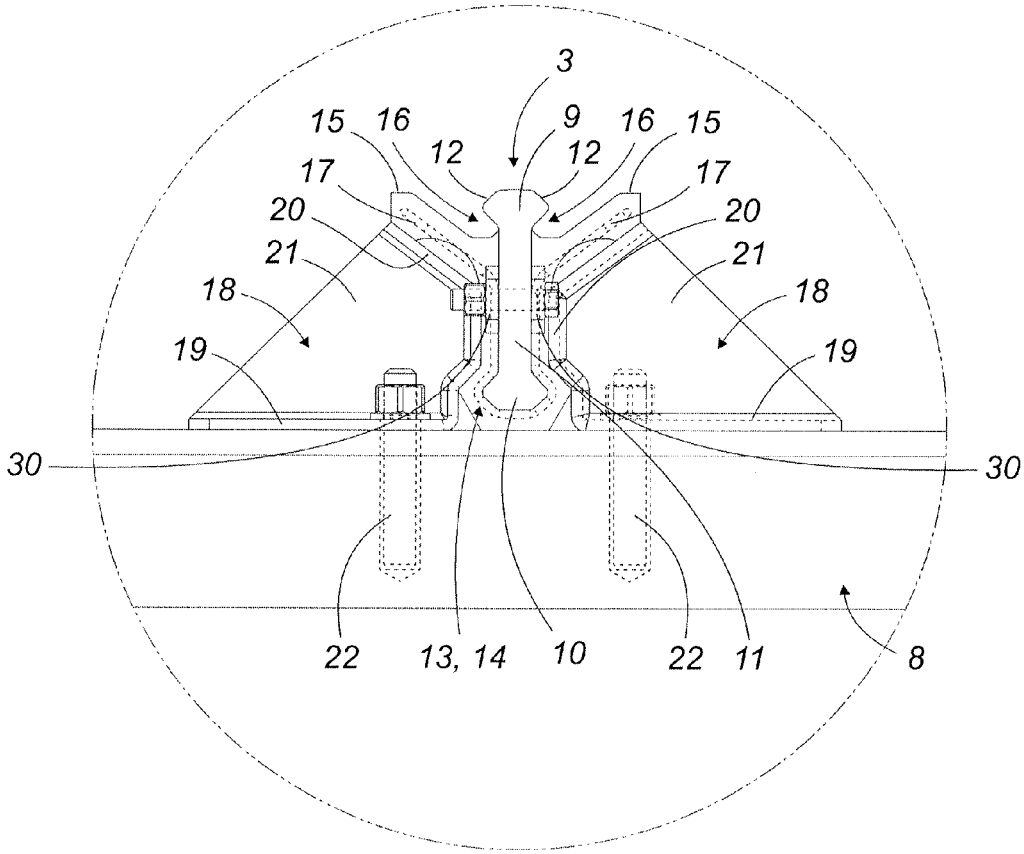
FIG. 5 is an enlarged perspective view of the front of a detail illustrating the attachment of the guide rail to a crossbar of the prefabricated track module according to the first embodiment of the invention.
Figure 6:
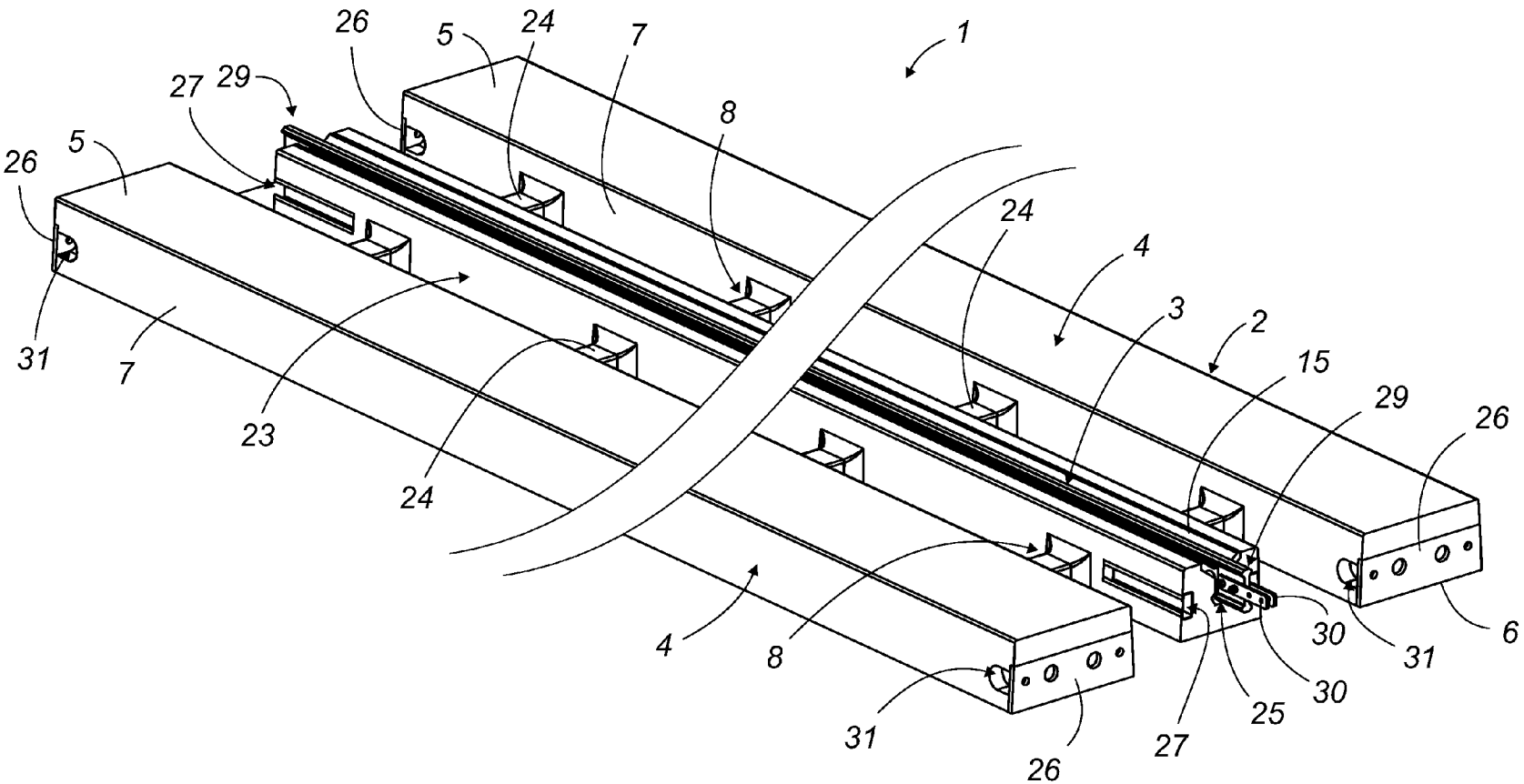
FIG. 6 is a perspective view of the front of a prefabricated track module according to a second embodiment of the invention.
Figure 11:
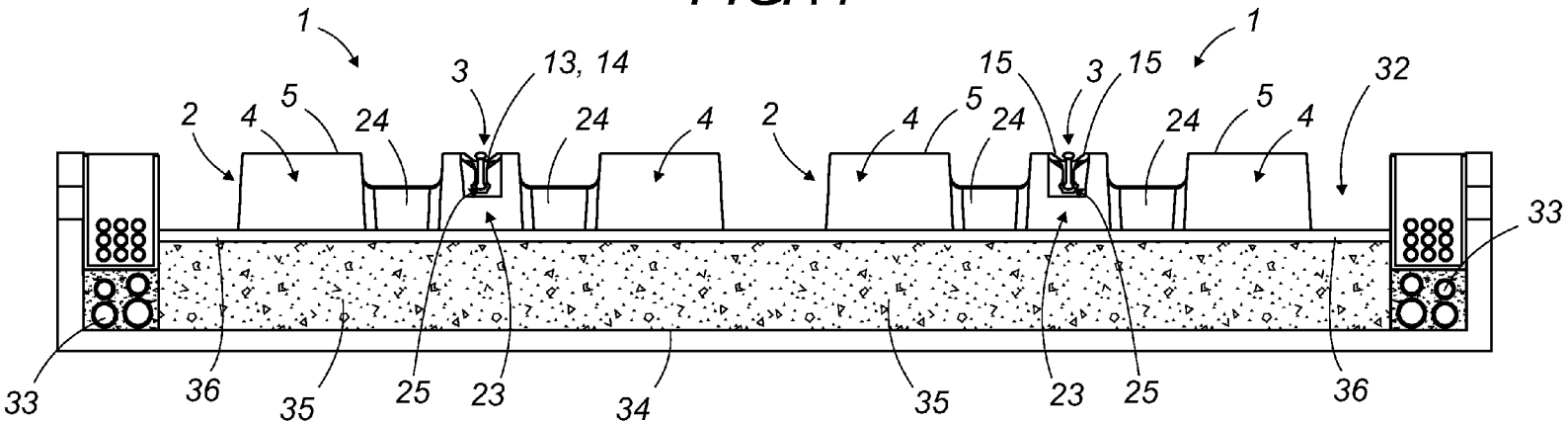
FIG. 11 is a transverse cross-section showing two parallel prefabricated track modules according to the second embodiment of the invention positioned in the base of a trench.

Advantageously, lower surface 39 of these connecting crossbars 8 also provides a ground-bearing surface for supporting structure 2 as can be seen in FIGS. 4 and 11.

Therefore, the entire integral monobloc concrete piece 2 is a supporting unit, that is, it contacts the ground. The downward force during passage of the urban transport vehicle is distributed on the lateral sills and the group of crossbars, thereby advantageously decreasing pressure and preventing the unit from being driven into the ground.

Thanks to this original concept, supporting structure 2 can be made thin enough to permit level installation with limited excavation work and allow it to be traversed by conventional road vehicles, flexible enough to adhere to a simply compacted terrain, yet remaining rigid enough to support the weight that is advantageously distributed over the entire supporting structure.

Crossbars 8 are, for example, generally rectangular in section and they are preferably spaced at regular intervals, for example, approximately one meter.

In the first embodiment of track module 1 according to the invention shown in FIGS. 1 through 5, these crossbars 8 directly connect the two lateral sills 4 and they support, preferably in their median portion, the guide rail section 3 for guiding the urban transport vehicle.

Guide rail 3 as shown has a generally I-shaped section with the extremities, specifically a head 9 and a foot 10, preferably being symmetrical and joined by an elongate narrow web 11 forming the axis of the "I."

Head 9 is shaped so as to have one or more edges 12 appropriate for use as a travel surface for the vehicle's guide roller or rollers, for example, for the two guide rollers angled in a V on a vehicle guide arm at the head of a series of tramway cars on tires.

Rail 3 as shown is rather high and has no significant contact surface at the lower portion. Therefore it is relatively flexible and adapts easily to curves along the route. Advantageously, it may be made only of straight pieces that can be curved during positioning if necessary to follow the outline of curved modules.

The conformation of guide rail 3 is preferably symmetrical relative to its median longitudinal plane in order to prevent the rail from tilting or twisting when it is being positioned on curves.

However, the shape of the guide rail may differ from the one shown as long as it is adapted for the guiding function that the guide rail must fulfill.

Advantageously the section of guide rail 3 may be coated with a lining material 13 on its lower and median portions, that is, in the variations shown, at the level of its foot 10 and its web 11.

This lining material 13 forms a covering 14 that essentially follows the contours of rail 3, but leaves its upper portion free, specifically head 9, to avoid interfering with the operational zones of guide rail 3 and with access to edges 12.

Preferably covering 14 extends, preferably upward, through a lateral extension15 of lining material 13 in which a lateral groove 16 is formed to eliminate interference with the dynamic grip of the guide rollers.

Depending upon the model of rail 3 and its application, such a lateral extension 15 may be provided on each side of rail 3.

Lining material 13 is any type of suitable synthetic material that is elastic enough to allow any objects located in the lateral guide groove to be evacuated, buried, or embedded when the guide roller passes. It is adapted for resistance to conditions of use and exterior climate conditions and advantageously, it may be electrically insulating.

The covering 14 is preferably added to or formed around the rail during or after manufacturing, for example, by extruding lining material 13 around rail 3.

Covering 14 may be reinforced, particularly at the level of its lateral extensions 15, by an internal metallic or non-metallic frame.

Figure 3:
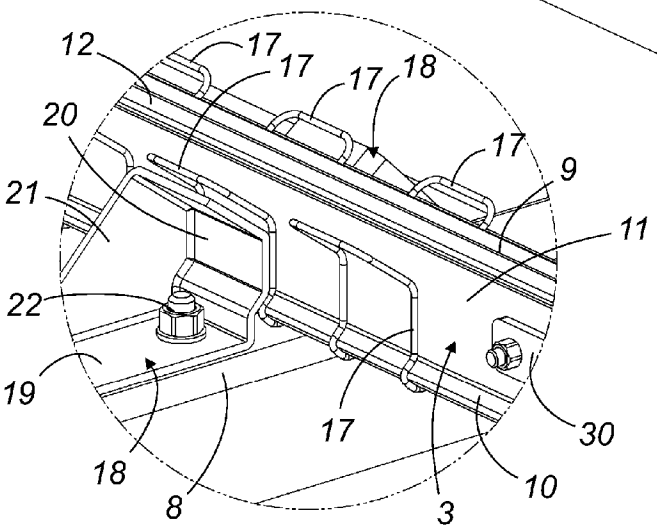
FIG. 3 is an enlarged perspective of the circled detail in FIG. 2, with the rail covering not shown.

This frame may advantageously take the form of clamps 17, particularly similar to those shown in FIG. 3 and possibly made of a concrete reinforcing bar. These clamps 17 preferably also improve the grip of coveringl4 around the section of guide rail 3 by gripping the covering against the rail preferably at regular intervals.

The guide rail sections 3 covered with their covering layer 14 are then positioned on supporting structure 2.

For this purpose the first embodiment of track module 1 according to the invention comprises immobilizing pieces 18 for fixing guide rail section 3 to each of the connecting crossbars 8.

Immobilizing pieces 18, as shown, may be essentially angled pieces comprising a generally planar base wall 19 resting on connecting crossbar 8 and a lateral contact wall 20 lying flat against the section of guide rail 3 preferably covered with lining material 13. Lateral contact wall 20 is preferably complementarily shaped with respect to the lateral shape of preferably coated rail section 3.

The immobilizing piece is preferably completed by a reinforcing wall 21 which connects the base wall 19 to lateral contact wall 20 closing one side of the immobilizing piece like a trihedron.

Two of these immobilizing pieces 18 are located at the level of each crossbar 8, one on either side of the guide rail section 3 so as to wedge it laterally between these pieces.

If the two sides of guide rail section 3 are generally symmetrical, the immobilizing pieces 18 used on either side of the rail may advantageously be identical, one simply being turned in the opposite direction of the other one.

Rail section 3 is solidly attached by bolting each immobilizing piece 18 to corresponding crossbar 8 using one or more attaching bolts 22 through base wall 19 of immobilizing piece 18.

In the second embodiment of the invention shown in FIGS. 6 through 12, supporting structure 2 further comprises a supplementary intermediate sill 23 located between the two lateral sills 4. This intermediate sill 23 preferably extends generally in the middle of the two lateral sills 4.

In this case crossbars 8 do not directly connect the two lateral sills 4 to one another. Each crossbar 8 is formed of two half-crossbars 24 each joining one lateral sill 4 to intermediate sill 23.

In this embodiment guide rail section 3 is mounted on intermediate sill 23. To do this, guide rail section 3 may be attached to intermediate sill 23, for example, or embedded in a complementary shaped channel 25 formed in this intermediate sill 23.

Channel 25 is open longitudinally at the level of the upper surface of intermediate sill 23 and its depth is adapted so that head 9 of guide rail 3 is essentially level with the upper surface of supporting structure 2, so that the urban transport vehicle is guided satisfactorily.

Prefabricated track modules 1 according to the invention are formed as rectilinear sections or optionally curved sections, of varying lengths, preferably of the order of ten to twelve meters long.

These prefabricated modules 1 are joined to one another, either directly or using an appropriate interface, and form, according to the invention, a track to be traveled by a self-guided urban transport vehicle on tires.

The concrete sills of two successive modules may be connected using complementary self-blocking shaped extremities, or by means of bolted connecting plates 26 such as those shown in FIGS. 6 through 10, for example, or by using grooves 27 such as the grooves formed at the extremity of intermediate sill 23 for attaching an intermediate piece 28 connecting successive sills.

According to another variation not shown the sills of two successive modules may simply be placed in juxtaposition, one in the extension of the other, without being assembled, with the connection between the two modules being limited to guide rail 3.

However, it is preferable for there to be a connection between successive modules to avoid ground shear at this level, as shearing over the long term could lead to module displacement. For this reason, a mechanical anti-shear connection is preferably provided between these sills.

At the extremity the guide rail section 3 preferably comprises a means for connection to the successive guide rail sections.

In the examples shown the two extremities 29 of the guide rail section 3 are left free, that is, with no covering 14, to facilitate connection to the adjacent sections of the guide rail. They also overlap beyond the corresponding extremity of intermediate sill 23 supporting guide rail 3, with the extremities of intermediate sill 23 set back from those of lateral sills 4.

Free extremities 29 on rail 3 are drilled to allow the bolting of two connecting strips 30 located on either side of guide rail web 11 and joining successive guide rail portion 3 by being bolted in the identical way at the level of its adjacent free end 29.

According to another possible embodiment, the successive guide rail portions 3 may be connected by welding.

FIGS. 7 through 10 illustrate the principal steps of one example of attaching two prefabricated track modules 1 according to the second embodiment of the invention.

Figure 7:
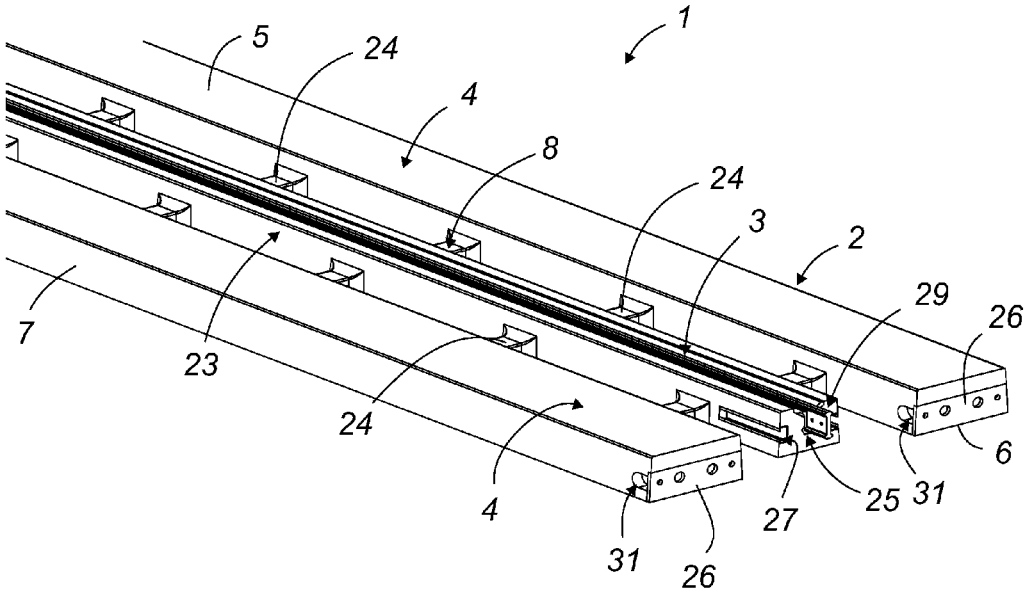
FIGS. 7 through 10 are perspective views showing the different steps in juxtaposing and assembling two prefabricated track modules one after the other according to the second embodiment of the invention.

The first prefabricated track module 1 is first of all placed in its implantation site as shown in FIG. 7.

Figure 8:
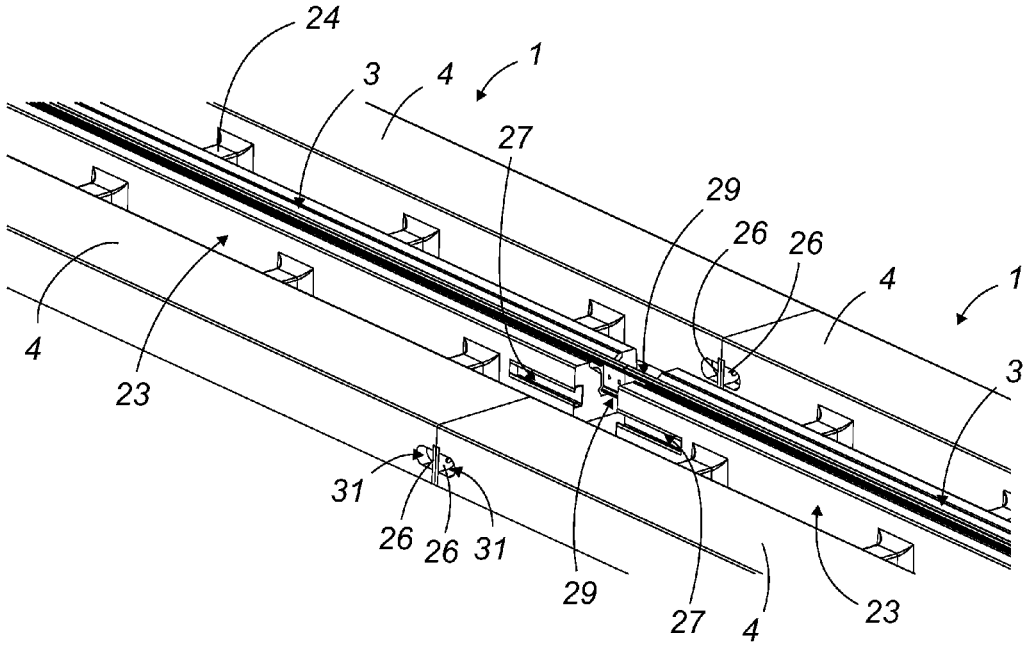
Figure 9:
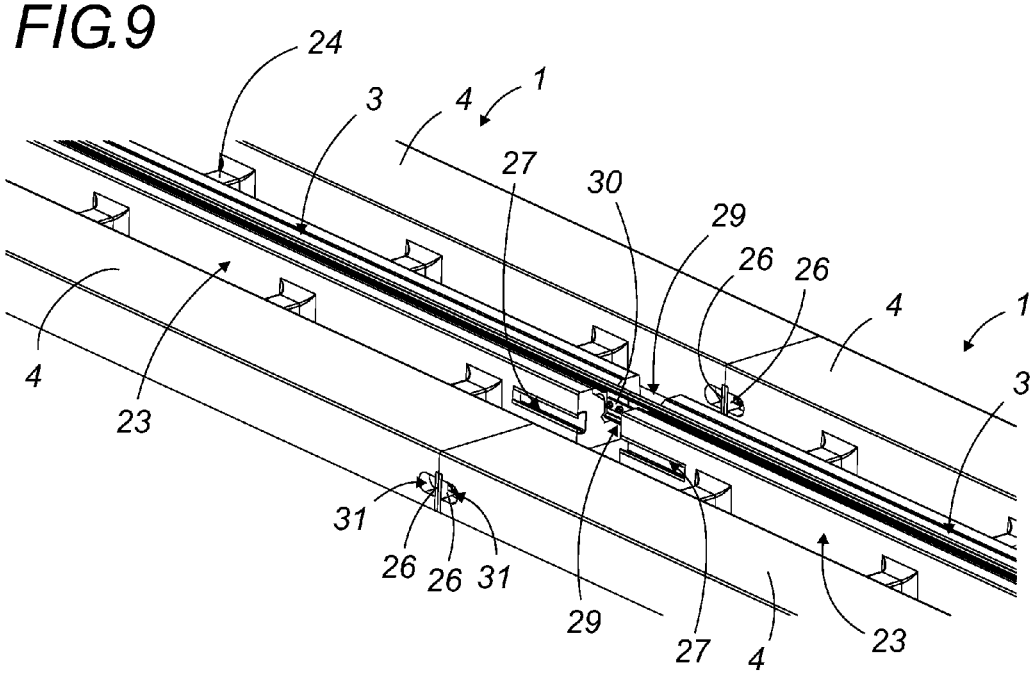

As seen in FIG. 8 a second prefabricated module 1, identical to or different from the first one but compatible with it, is then juxtaposed after the first one. The two modules are aligned correctly in relation to each other.

To ensure continuity of the track, the two modules are then joined to each other. In the example shown in FIG. 9, assembly may take place by bolting connecting plates 26 two by two at the extremity of each lateral sill 4. An access groove 31 located at the extremity of each lateral sill 4 behind these plates 26 allows bolting to take place.

The extremities of the two guide rail sections 3 are also connected to each other using two connecting strips 30 as described above.

Figure 10:
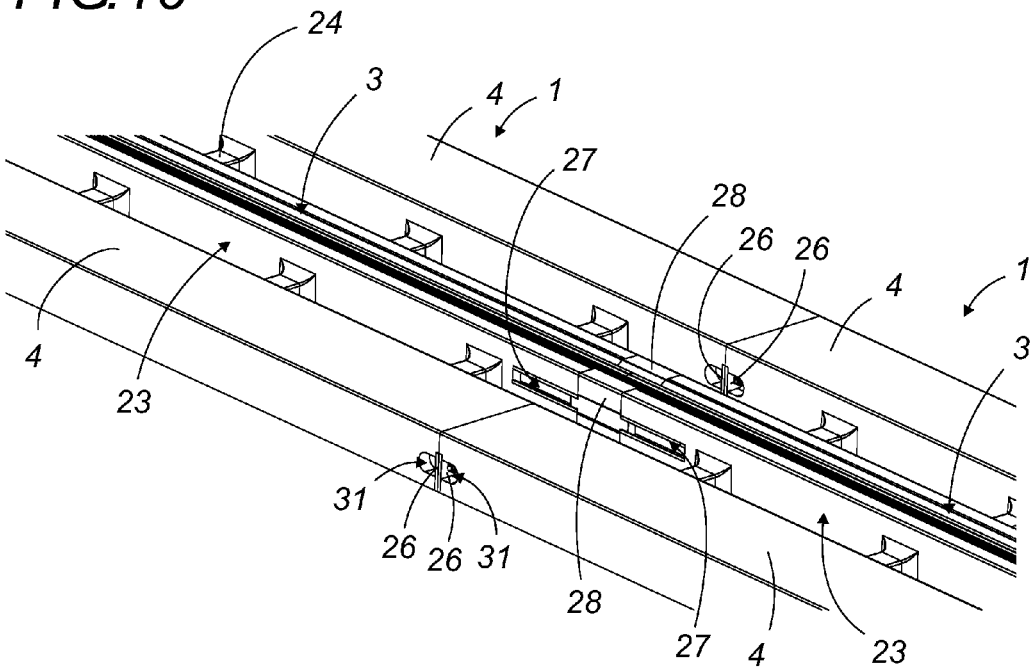

FIG. 10 shows a step of finishing the rail in which an intermediate connecting piece 28 is attached around guide rail 3 at the junction between its two sections in order to achieve continuity between the intermediate sills 23 of the two successive modules. This intermediate connecting piece 28 is attached using grooves 27 formed in the extremity of intermediate sills 23.

Factory prefabricated modules 1 may advantageously be transported by truck to their installation site where they are unloaded and positioned using the appropriate lifting apparatus.

Prefabricated track modules 1 may either be immobilized in a trench 32 or positioned on top of a preexisting finished ground surface, for example, a street.

Figure 12:
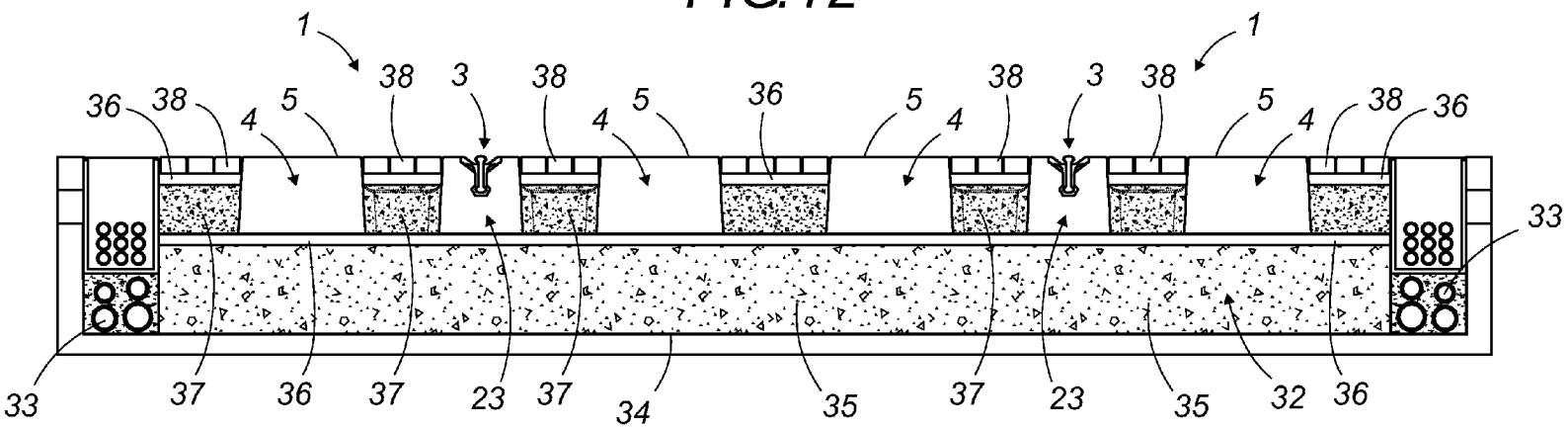
FIG. 12 is a view similar to FIG. 11 in which the intermediate free spaces have been filled with suitable fill material and finished with a decorative surface covering.

When the track according to the invention is installed in a trench 32 as in the example of FIGS. 11 and 12, it does not need to be positioned on a foundation or a concrete platform as with prior art tracks. Once the urban mains 33 are rerouted, simply compacting the base 34 of the trench 32 is sufficient, as lateral sills 4 support the weight of the vehicle and the stress of motion.

According to this exemplary embodiment, the lower portion of trench 32 is filled to a certain level with an appropriate drainage material 35, for example, untreated gravel. This material is then covered with a bed of sand 36 forming an anchor surface, flat and stable, for placement of prefabricated track modules 1.

After being connected, the track modules are buried up to a certain level in an appropriate fill material 37 to immobilize the supporting structure sufficiently. The free intermediate space between the two lateral sills 4 is also filled using fill material 37.

Advantageously, the trench depth and sill height are selected so that the upper surface 5 of lateral sills 4 serving as the travel surface and head 9 of guide rail 3 are essentially level with the ground level.

The entire installation can be completed on the surface with a decorative or technical covering 38 or landscaping such as grass or some type of planting. Covering 38 is preferably in the form of plates, for example, flagstones, stone slabs, tiled blocks or areas planted with grass, preferably also placed on a bed of sand 36.

The invention obviously is not limited to the preferred embodiments described and shown above, but additionally comprises all the numerous variations and modifications belonging to the same inventive concept that a person skilled in the art might easily imagine.

Thus, for example, two globally planar and horizontal track modules 1 have been described and shown. It is also possible to construct modules which when seen in transverse cross-section would be angled like a "circumflex accent mark" as many streets are to improve rainwater runoff and limit formation of frost.

Another imaginable variation would be the manufacture of prefabricated track modules which comprise in addition to the guide rail an electric supply rail 40 for the urban transport vehicle, for example, a lateral rail, as schematically represented in FIG. 4.

The invention claimed is:

1. A track module (1) to be juxtaposed one after the other to form a track for self-guided urban transport vehicles on tires, the track module being prefabricated at a factory and comprising:

an integral monobloc concrete supporting structure (2) comprising two lateral sills (4) with a generally planar upper surface (5) serving as a travel surface for tires of an urban transport vehicle, an intermediate sill (23), located between the two lateral sills (4), and connecting crossbars (8) joining the lateral sills (4) via the intermediate sill (23) and maintaining the lateral sills (4) generally parallel with one another, and a lower surface (6) of the lateral sills (4) and a lower surface (39) of the connecting crossbars (8) being ground bearing surfaces; and a guide rail section (3) for guiding the urban transport vehicle, being embedded in a complementary shaped channel (25) formed in the intermediate sill (23); and an intermediate piece (28) being attached at an extremity of the intermediate sill (23), around the guide rail section (3), in order to achieve continuity between the intermediate sill (23) of said module and the intermediate sill of another juxtaposed module.

2. The track module (1) according to claim 1, wherein the track module (1) is one of substantially rectilinear, curved, and generally trapezoidal in shape.

3. The track module (1) according to claim 1, wherein the supporting structure (2) is either partially or completely manufactured from reinforced concrete.

4. The track module (1) according to claim 1, wherein the lateral sills (4) are substantially rectangular in shape.

5. The track module (1) according to claim 1, wherein the lateral sills (4) comprise one of a generally convex upper surface (5) and adhering ribs.

6. The track module (1) according to claim 1, wherein the guide rail section (3) is located substantially at a central position between the lateral sills (4).

7. The track module (1) according to claim 1, wherein the guide rail section (3) is affixed to the supporting structure (2) at a level of each one of its connecting crossbars (8) using immobilizing pieces (18).

8. The track module (1) according to claim 1, wherein the guide rail section (3) is wedged between two immobilizing pieces (18), bolted to the corresponding connecting crossbar (8), at a level of each of the connecting crossbars (8).

9. The track module (1) according to claim 1, wherein the guide rail section (3) is generally I-shaped with a head (9) serving as a travel surface for at least one vehicle guide roller and a foot (10) that is connected to the hear by an elongated narrow web (11).

10. The track module (1) according to claim 1, wherein the guide rail section (3) has no significant lateral inertia and a head (9) and a foot (10) that are essentially symmetrical.

11. The track module (1) according to claim 1, wherein a lower portion of the guide rail section (3) is covered with a lining material (13) forming a covering (14) that extends upward through at least one lateral extension (15) which defines a lateral guide groove (16) between the extension and the head (9) of the rail (3).

12. The track module (1) according to claim 1, wherein the guide rail (3) is positioned after the supporting structure (2).

13. The track module (1) according to claim 1, wherein the track module (1) is designed to at least one of be positioned directly on top of one of a street and a preexisting finished ground surface and buried in a trench (32), a base (34) of which has been simply prepared and compacted.

14. The track module (1) according to claim 1, wherein an intermediate free space between the two lateral sills (4) is designed to be filled with suitable fill material (37), completed on a surface with one of a decorative or technical coating (38), in the form of plates.

15. The track module (1) according to claim 1, wherein the track module (1) further comprises an electric supply rail (40) for the urban transport vehicle.

16. The track module (1) according to claim 1, wherein the track module (1), when viewed transverse cross-section. is angled like a "circumflex accent mark."

17. A track module (1) to be juxtaposed one after the other to form a track for self-guided urban transport vehicles on tires, the track module being prefabricated at a factory and comprising:

an integral monobloc concrete supporting structure (2) comprising two lateral sills (4) with a generally plane upper surface serving as a travel surface for tires of an urban transport vehicle, and connecting crossbars (8) joining the lateral sills (4) and maintaining the lateral sills (4) generally parallel with one another, and a lower surface (6) of the lateral sills (4) and a lower surface (39) of the connecting crossbars (8) being ground bearing surfaces; and a guide rail section (3) being attached to the supporting structure (2) for guiding the urban transport vehicle;

the guide rail section and the lateral sills extend longitudinally, extremities of the lateral sills at a first longitudinal end of the track module are laterally aligned with each other, wherein a longitudinal extremity of the guide rail section (3) at the first longitudinal end of the track module is longitudinally offset with respect to the extremities of the lateral sills (4) at the first longitudinal end of the track module such that the extremities of the lateral sills (4) at the first longitudinal end of the track module are longitudinally spaced from the longitudinal extremity of the guide rail section (3).

18. A track for a self-guided urban transport vehicle on tires, the track being formed of a succession of prefabricated track modules (1) juxtaposed one after the other, the track module being prefabricated at a factory and comprising:

an integral monobloc concrete supporting structure (2) comprising two longitudinally aligned lateral sills (4) with a generally planar and permanently integral upper surface serving as a travel surface for tires of an urban transport vehicle, an intermediate sill (23), located between the two lateral sills (4), and connecting crossbars (8) joining the lateral sills (4) via the intermediate sill and maintaining the lateral sills (4) generally parallel with respect to one another, and a lower surface (6) of the lateral sills (4) and a lower surface (39) of the connecting crossbars (8) being ground bearing surfaces, longitudinal extremities of the two lateral sills are laterally aligned with each other, such that the longitudinal extremities of the lateral sills of successive track modules abut each other;

a guide rail section (3) for longitudinally guiding the urban transport vehicle, being embedded in a complementary shaped channel (25) formed in the intermediate sill (23), longitudinal extremities of the intermediate sill are longitudinally offset with respect to the longitudinal extremities of the two lateral sills, such that when the longitudinal extremities of the lateral sills of the successive track modules abut each other, the longitudinal extremities of the intermediate sills of the successive track modules are spaced from each other; and an intermediate piece (28) being attached at the longitudinal extremities of the intermediate sills (23), around the guide rail section (3), in order to achieve continuity between the intermediate sills (23) of the successive track modules.

* * * * *